United States Patent [19]

Bott

[11] Patent Number: 4,848,065

[45] Date of Patent: Jul. 18, 1989

[54] AUTOMATIC BOTTLE BAGGER

[75] Inventor: Jerry A. Bott, Grand Rapids, Mich.

[73] Assignee: Automatic Inspection Systems, Grand Rapids, Mich.

[21] Appl. No.: 880,127

[22] Filed: Jun. 30, 1986

[51] Int. Cl.[4] ..... B65B 21/00; B65B 35/40; B65B 43/30; B65B 51/14

[52] U.S. Cl. ..... 53/48; 53/496; 53/543; 53/570; 53/373; 156/385

[58] Field of Search ..... 53/570, 543, 496, 258, 53/48, 373, 572, 538, 537, 261, 247, 384, 77; 156/385

[56] References Cited

U.S. PATENT DOCUMENTS

| | | | |
|---|---|---|---|
| 2,470,795 | 5/1949 | Socke . | |
| 2,613,021 | 10/1952 | Bowes | 53/496 |
| 2,684,799 | 7/1954 | Holstein . | |
| 2,703,182 | 3/1955 | Broberg et al. . | |
| 2,738,116 | 3/1956 | Barraclough . | |
| 2,739,718 | 3/1956 | Birchall . | |
| 2,834,167 | 5/1958 | Loveridge | 53/496 |
| 2,850,855 | 9/1958 | Offutt | 53/384 X |
| 2,956,381 | 10/1960 | Chauvin et al. . | |
| 2,969,629 | 1/1961 | Blais | 53/384 X |
| 3,301,376 | 1/1967 | Winter, IV et al. . | |
| 3,877,562 | 4/1975 | Shaw | 53/543 |
| 3,887,060 | 6/1975 | Kamphues . | |
| 4,003,185 | 1/1977 | Goff | 53/543 X |
| 4,231,697 | 11/1980 | Franz . | |
| 4,248,032 | 2/1981 | Woods et al. | 53/570 |
| 4,265,074 | 5/1981 | Reuter et al. | 53/573 X |
| 4,343,390 | 8/1982 | Laub, III | 53/543 X |
| 4,419,854 | 12/1983 | Okada et al. . | |
| 4,439,084 | 3/1984 | Werkheiser . | |
| 4,589,812 | 5/1986 | Meives et al. . | |

*Primary Examiner*—Horace M. Culver

*Attorney, Agent, or Firm*—Varnum, Riddering, Schmidt & Howlett

[57] ABSTRACT

A bottle bagger (10) for bagging a plurality of bottles (12) in a plastic bag (14) comprises an upstream part (16), a downstream part (18), a table assembly (20), a pusher assembly (22), a sealing assembly (24) and a bag holder assembly (25). In operation, the bag (14) is first placed on the bag holder assembly (25) with the open end of the bag facing the upstream part (18) of the bagger (10). Bottles (12) are fed seriatim by a conveyor (44) onto an infeed table (26) of the table assembly (20) and are thereafter pushed downstream into the plastic bag (14) and onto an outfeed table (76) of the table assembly (20) by a pusher paddle (132) of the pusher assembly (22). Subsequently, the bag (14) is sealed and excess plastic from the bag is severed upstream of the seal by upper and lower sealing jaws (198, 192) of the sealing assembly (24). The bagged bottles (14) are then ready for storage or shipment.

33 Claims, 7 Drawing Sheets

AUTOMATIC BOTTLE BAGGER

FIELD OF THE INVENTION

The invention relates to an apparatus for packaging plastic bottles in plastic bags. More specifically, the invention relates to an apparatus used by manufacturers of "blow molded" plastic milk bottles and which automatically packages the bottles in plastic bags so that they can thereafter be conveniently stored or shipped to dairies for filling with milk.

BACKGROUND OF THE INVENTION

Apparati for use in packaging plastic bottles in plastic bags are known. For example, a manual-operated bagger comprises a loading platform, a plurality of vertical walls framing the platform and a roller rotatably mounting a roll of plastic bags. In operation, rows of bottles are positioned on the platform within the confines of the vertical walls and thereafter cardboard is placed on the tops of the bottles. A second layer of bottles is then positioned on top of the cardboard and a second cardboard is set on the tops of the second layer of bottles. This process of stacking layers of bottles separated by layers of cardboard continues until the platform is filled. Thereafter, the roller is rotated and a plastic bag is drawn off the roll and over the vertical walls and the platform. The platform is then rotated and the bag packaging the bottles is removed out of engagement from the walls and the platform. Once so removed, the open end of the bag is sealed by a suitable mechanical means.

The principal drawback of the manual bagger is its inefficiency. Since the bagger is manually operated, the speed at which bottles can be bagged is limited to the speed at which the operator can operate the bagger. In addition, the bottles bagged by the bagger are subjected to unsanitary conditions. The cardboard used in the bagging process is associated with dirt and dust which inevitably contaminates the interior of the bottles. This presents a sanitation problem for those in the dairy industry wherein bottles packaged by the bagger are shipped to dairies for filling with milk. If the bottles are contaminated, the dairies are required to clean the bottles prior to the filling process. This cleaning process is relatively expensive. Further, the cardboard is an expense which could be avoided.

Another bottle bagger currently available is manufactured by Dyco, Inc., of Berwick, Pa. This bagger comprises first and second platforms set in offset juxtaposition with respect to one another. The first platform has a first end and a second end and a first pusher is movable between the first and second ends. The second platform has first and second sides and a second pusher is movable between the second end of the first platform and the first side of the second platform. A third pusher is movable between the first and second sides of the second platform. The bagger also includes bag holder and sealing assemblies positioned midway between the first and second sides of the second platform. The bag holder assembly holds a bag such that the opened end of the same faces the first side of the second platform. In operation, bottles are first fed seriatim by a conveyor onto the first end of the first platform until a row of bottles is allowed to accumulate thereon. The row is then moved onto the second end of the first platform by the first pusher. After a predetermined number of rows of bottles have so accumulated on the second end of the first platform, the second pusher moves the rows of bottles laterally from the second end of the first platform to the first side of the second platform. The third pusher then forces the bottles into the bag. Sealing jaws of the sealing assembly subsequently close the open end of the bag and a pair of heated wires on the jaws seal the bag and sever excess plastic of the bag at the seal. The sealed bag packaging the bottles is thereafter moved off the second side of the second platform for storage or shipping.

The main drawback of the Dyco bagger is its inefficiency. As stated above, each row of bottles fed onto the first end of the first platform is individually pushed by the first pusher the full distance between the first and second ends of the first platform. This process of accumulating a plurality of rows of bottles on the second end of the first platform is time consuming.

To improve the speed at which a bagger can accumulate a plurality of rows of bottles so that they can thereafter be pushed into a bag for packaging, it has been found desirable to push each row of bottles fed onto a first end of a platform a relatively short distance sufficient to allow another row of bottles to be loaded onto the first end of the platform. These short movements of a pusher on the first end of the platform would continue until a predetermined number of rows of bottles accumulate on the first end whereupon the pusher then forces the accumulated rows the full distance to a second end of the first platform for loading into the bag. It has been found that this latter process is twice as fast as the former process of pushing each row of bottles individually from one end of a platform to another end of the same.

Another drawback of the Dyko bagger is the complexity of the same, which requires a plurality of pushers performing functions which could be accomplished by a single pusher. The Dyko bagger requires three pushers to move rows of bottles from the first end of the first platform to within the bag on the second side of the second platform. It has been found desirable to employ one pusher rather than three to push a plurality of rows of bottles from one end of a first platform to within a bag on the outboard end of a second platform.

SUMMARY OF THE INVENTION

According to the invention, an apparatus packages or loads articles into an open end of a bag and comprises a table for supporting the articles and having an upstream portion and a downstream portion, a conveyor means for feeding the article seriatim onto the upstream portion of the table so as to form a row of articles on the table, a bag holder means for supporting the bag on the downstream portion of the table such that the open end of the bag faces upstream, a pusher means for forcing the row of articles from the upstream portion to the downstream portion and into the bag through the open end of the bag, and a sealing means for sealing the open end of the bag.

The apparatus also comprises a control means for moving the pusher means a relatively short distance on the upstream portion of the table to move a first row of articles a sufficient distance to enable a second row of articles to be fed onto the upstream portion of the table just upstream of the first row. In this manner, a predetermined number of rows of articles can be accumulated on the upstream portion of the table before the predetermined rows are pushed into the bag, and the pusher means can push an entire bag load at once into the bag, thereby speeding up the operation considerably.

A first detection means is provided for detecting the presence of the first row of articles on the upstream portion of the table. The control means is operatively connected to the first detection means and responds to the detected presence of the first row on the table to move the pusher means and thus the first row of articles downstream a relatively short distance on the table. A second detection means detects the relatively short movement of the pusher means. The control means is also operably connected to the second detection means and responds to the detected relatively short movement of the pusher means to move the pusher means upstream to an initial position. A third detection means detects the presence of pusher means at the initial position on the table.

The control means further includes a counter means for counting each relatively short distance movement of the pusher means on the table, and a first actuating means for actuating movement of the pusher means to the downstream portion of the table to push accumulated rows of articles on the upstream portion of the table into the bag after a predetermined number of counts of the counter means. In addition, the control means includes an interlock means operatively connected to the counter means and responsive to the predetermined number of counts of the counter means for disabling the first actuating means to prevent the pusher means from moving from its initial position. The control means further includes a manually fill switch means operatively connected to the first actuating means for releasing the interlock means and activating the first actuating means to move the pusher means from its initial position to the downstream portion of the table to push the accumulated rows of articles into the bag.

A fourth detection means is provided for detecting the movement of the pusher means to the downstream portion of the table. The control means is operatively connected to the fourth detection means and is responsive thereto to actuate movement of the pusher means to its initial position on the table. The control means further comprises a resetting means operatively connected to the fourth detection means and the counter means and responsive to movement of the pusher means to the downstream portion of the table for resetting the counter means.

The pusher means comprises a first interference means for interfering with seriatim feeding of the articles onto the table by the conveyor means when the pusher means is moved the relatively short distance on the table. Further, a second interference means is movably mounted on the upstream portion of the table for interfering with seriatim feeding of the articles onto the table by the conveyor means when the pusher means is moved to the downstream portion of the table. The control means is responsive to the movement of the pusher means to the downstream portion of the table to move the second interference means to a position of interference with the feeding of the articles onto the table when the pusher is moved to the downstream portion of the table.

The sealing means comprises a pair of opposed sealing jaws positioned adjacent to the open end of the bag, and a means for mounting the sealing jaws for movement between an open position where the jaws are positioned in spaced-apart relationship and a clamping position where the jaws are in confronting relationship with one another. The control means also comprises a second actuating means for moving the sealing jaws from the open position to the clamping position under a first pressure when the pusher means moves from the downstream portion to its initial position. The control means further comprises a manually operated palm button means operatively connected to the second actuating means for activating the second actuating means to move the sealing jaws from the open position to the clamping position under the first pressure.

Preferably, a fifth detection means is provided to detect the presence of the sealing jaws in the clamping position. The control means is further operatively connected to the fifth detection means and is responsive to the detected presence of the sealing jaws in the clamping position to drive the jaws together under a second pressure greater than the first pressure.

The sealing means further comprises a thermal severing means for applying heat to the open end of the bag to seal the bag and sever excess material from the bag at the seal. The control means is further responsive to the detected presence of the sealing jaws in the clamping position to activate the thermal severing means to apply heat to the bag.

The control means further comprises a first timer means operatively connected to the fourth detection means and responsive to the detected presence of the pusher means to the downstream portion of the table for measuring a predetermined time segment. The control means is further responsive to the first timer means to move the jaws to the pen position in the event that the predetermined time segment expires before the detection of the jaws in the clamping position by the fifth detection means.

In the preferred embodiment of the invention, the first pressure used to drive the jaws together is approximately 20 psi and the second pressure is approximately 80 psi.

The bag holder means is positioned upsteam of the sealing means and comprises an upper holder means for holding an upper portion of the bag above the table and a lower holder means for holding a lower portion of the bag below the table. To this end, the lower holder means comprises feet means movable between a bottom position where the feet means are out of engagement with the table and a top position where the feet means engage the table for securely clamping the lower portion of the bag to the underside of the table. And, the upper holder means comprises a bucket means mounted for pivotable movement between a lower position where the bucket means is adapted to receive the upper portion of the bag and an upper position where the bucket means securely holds the upper portion of the bag above the table means.

The control means also comprises a third actuating means for actuating movement of the feet and bucket means between the bottom and lower positions and the top and upper positions, respectively. A manually operated foot switch means is provided for activating the third actuating means to move the feet and bucket means to the bottom and lower positions, respectively, when the foot switch means is activated and to move the feet and bucket means to the top and upper positions, respectively, when the foot switch means is deactivated. A second timer means of the control means is operatively connected to the foot switch means and measures a second predetermined time period with the foot switch is deactivated. The control means is responsive to the second timer means to move the bucket means to the upper position at the expiration of the second time period.

The invention further contemplates a method for packaging or loading articles into a bag having an open end. The method comprises feeding articles seriatim onto a table to accumulate a first row of articles on the table, moving the first row of articles a short distance sufficient to permit the feeding of a second row of articles onto the table adjacent the first row, feeding a second row of articles, continuing the foregoing steps until a predetermined number of rows having accumulated on the table, and thereafter moving the predetermined number of rows of articles collectively into the open end of the bag, and subsequently sealing the bag.

BRIEF DESCRIPTION OF THE DRAWINGS

Reference will now be made to the drawings in which.

DESCRIPTION OF THE PREFERRED EMBODIMENTS

Figure 1A:
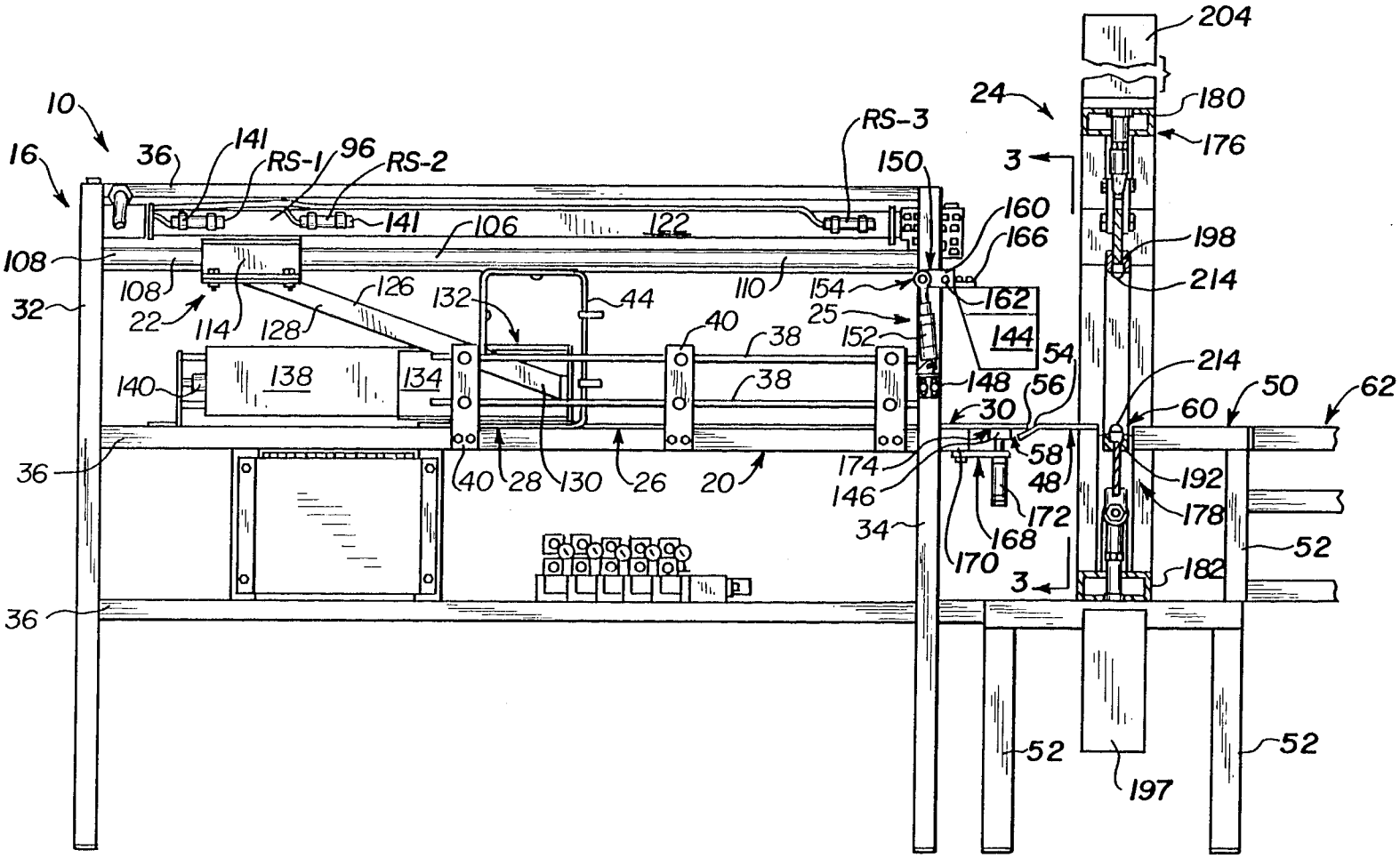
FIG. 1A is a side, elevational view upstream portion of a bagger of the invention.

Referring now to the drawings in detail, there is shown a bottle bagger 10 for bagging or packaging a plurality of bottles 12 in plastic bags 14 so that the packaged bottles can thereafter be practically and conveniently shipped for filling and stored in sanitary conditions. Although the bagger 10 is particularly adapted for use in packaging blow-molded plastic bottles, a wide variety of containers, can be packaged utilizing the bagger 10 of this invention.

The bagger 10 is generally defined as having an upstream portion 16 and a downstream portion 18, these portions corresponding to locations on the bagger where the bottles 12 are initially fed onto the bagger for packaging and where the packaged bottles are removed from the bagger for shipping or storage, respectively. In addition, for purposes of explanation, elements of the bagger 10 will often be referred to as having upstream portions and downstream portions and certain elements of the bagger will be referred to as being positioned upstream or downstream relative to other elements of the same.

The bagger 10 generally comprises a table assembly 20, a pusher assembly 22, a sealing assembly 24 and a bag holder assembly 25. As best illustrated in FIG. 1A, the table assembly 20 includes a rectangular, infeed table 26 having an upstream end 28 and a downstream end 30 and supported by floor-engaging upstream and downstream vertical frame members 32, 34 and horizontal frame members 36 rigidly secured to the upstream and downstream vertical frame members. The upstream and downstream vertical frame members 32, 34 extend upwardly a predetermined distance above the infeed table 26 and support the pusher assembly 22 above the same as will be hereinafter explained in detail. A plurality of side rails 38 are rigidly connected to a pair of horizontal frame members 36 by a number of rail supports 40 and positioned adjacent to and extending along longitudinal sides 42 of the infeed table 26.

An infeed conveyor 44 is attached to and positioned adjacent a longitudinal side 42 of the infeed table 26, at the upstream end 28 thereof. The conveyor 44 functions to feed bottles 12 seriatim onto and transversely across the upstream end 28 of the infeed table 26. The conveyor 44 is of the type conventionally utilized in a variety of commercial and industrial environments to transport articles, in the present case bottles 12, from one stage of production or assembly to another. A conveyor which can be employed in operation of the invention is a conventional gravity feed conveyor.

In the drawings, the infeed conveyor 44 is positioned on the left side 42 of the infeed table 26 from the viewpoint from the upstream end 28 of the infeed table, looking downstream. It should be noted, however, that the conveyor 44 can also be disposed on the right side 42 of the infeed table 26 from the same viewpoint. Whether the conveyor 44 is positioned on the left or right side of the bagger 10 may depend on the particular requirements of the industrial or commercial environment in which the same is being used.

Figure 2A:
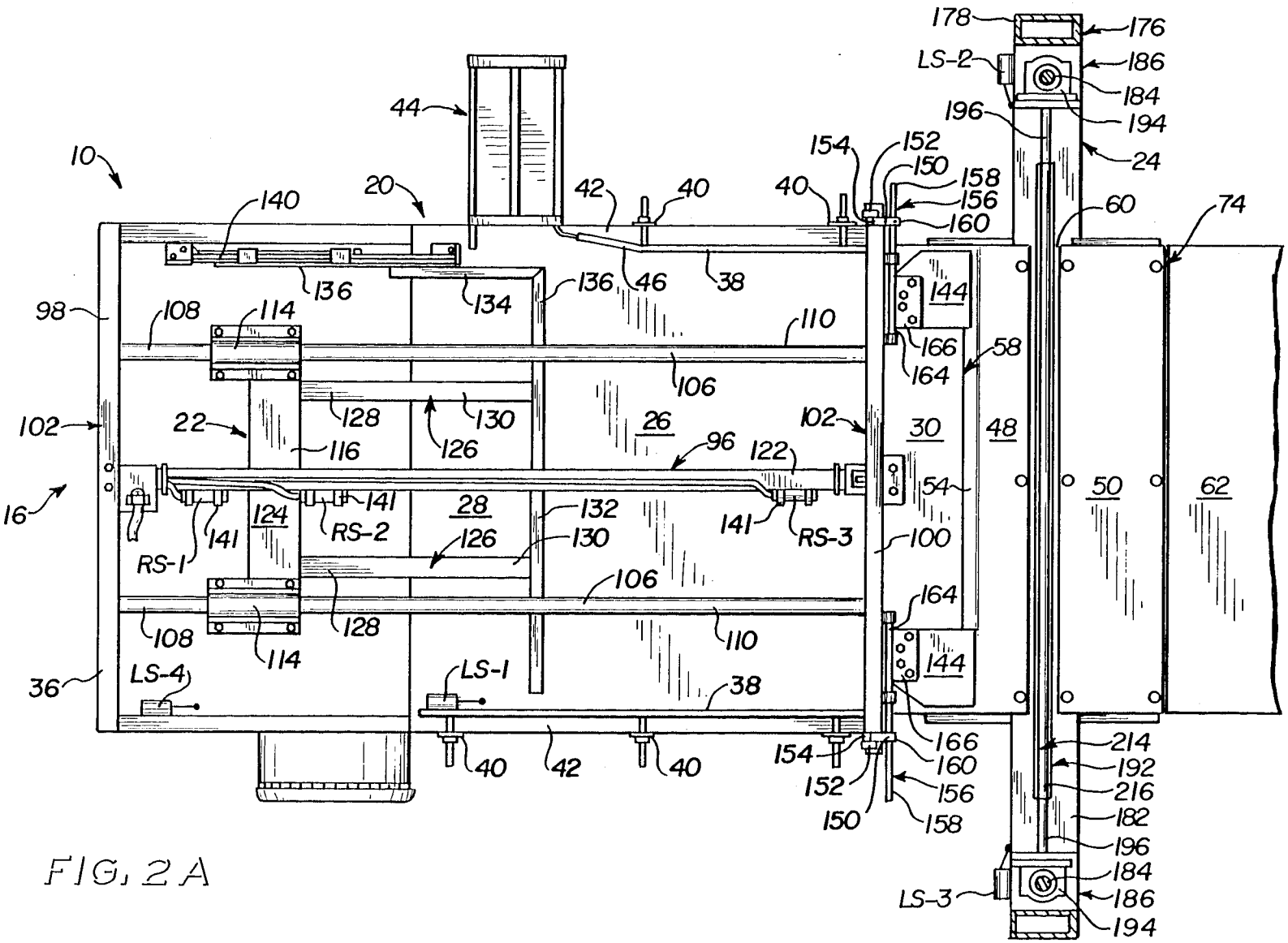
FIG. 2A is a plan view of the upstream portion of the bagger.

As most clearly illustrated in FIG. 2A, the side rails 38, on the left, longitudinal side 42 of the infeed table 26 from the above-stated viewpoint, include an angled portion 46 attached to and positioned directly upstream of the conveyor and for preventing bottles 12 from falling off the infeed table when being loaded on the same. The side rails 38 on both sides 42 of the infeed table 26 function to prevent bottles 12 loaded thereon from falling off of the table and to aid the bagger in organizing the bottles in rows for subsequent bagging.

As shown in FIGS. 1A and 2A, the table assembly 20 also includes an infeed table plate 48 and an outfeed table plate 50. The infeed table plate is securely mounted to horizontal frame members 36 and vertical frame members 52 of the table assembly 20 and is positioned immediately downstream of and coextensive with infeed table 26. In addition, the infeed table 48 has an upstream edge 54 thereof bent downwardly, set at an acute angle with respect to the horizontal and extending somewhat beneath a downstream axial edge 56 of the infeed table 26. The upstream bent edge 54 of the infeed table plate 48 forms an elongated slot 58 between the same and the infeed table, with the slot extending parallel to a full, transverse axis of the infeed table plate. The outfeed table plate 50 is securely attached to vertical and horizontal frame members 52, 36 of the table assembly 20. In addition, the outfeed table plate is substantially coextensive with and positioned in spaced-apart relationship to the infeed table plate 48, thereby forming a space 60 between the infeed and outfeed table plates. As explained in detail below, the sealing assembly 24 is positioned between the infeed and outfeed table plates 48, 50 and operates in the space 60.

Figure 3:
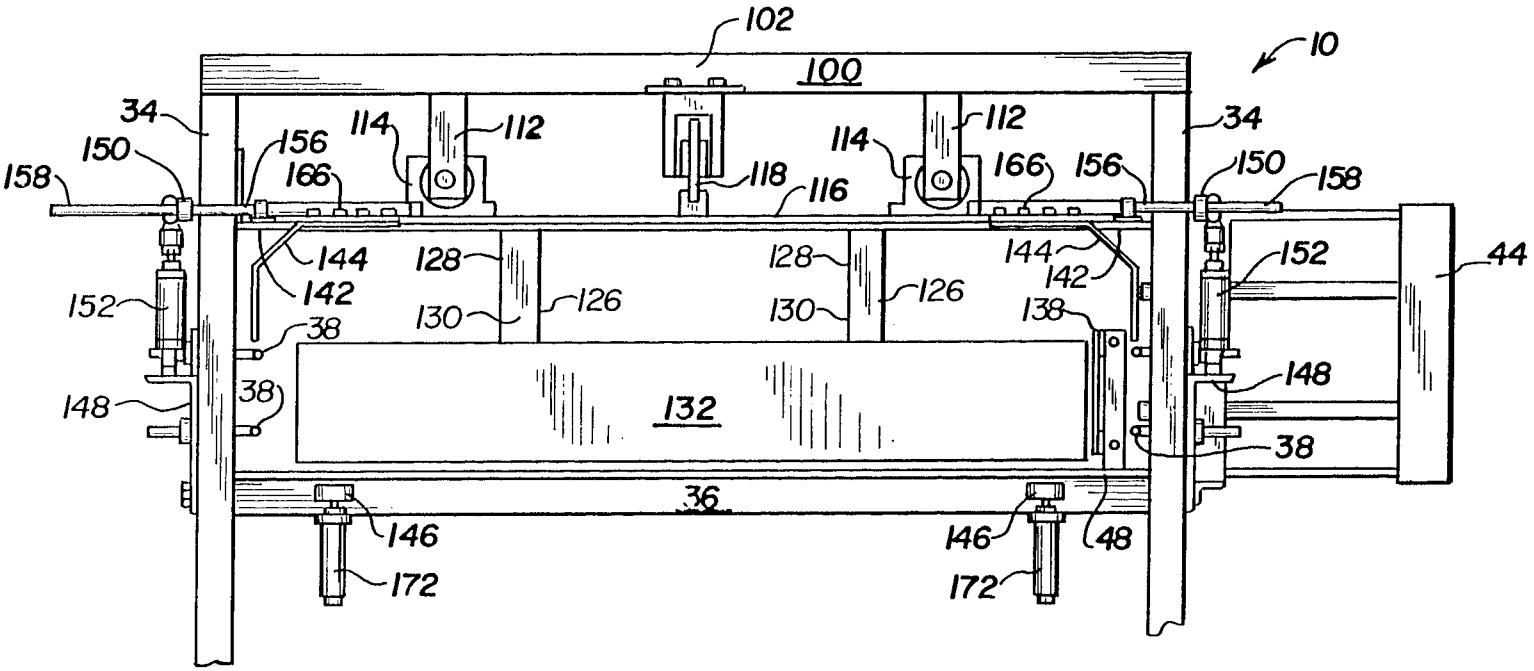
FIG. 3 is a cross-sectional view of the bagger looking upstream taken along lines 3–3 of FIG. 1A.
Figure 4:
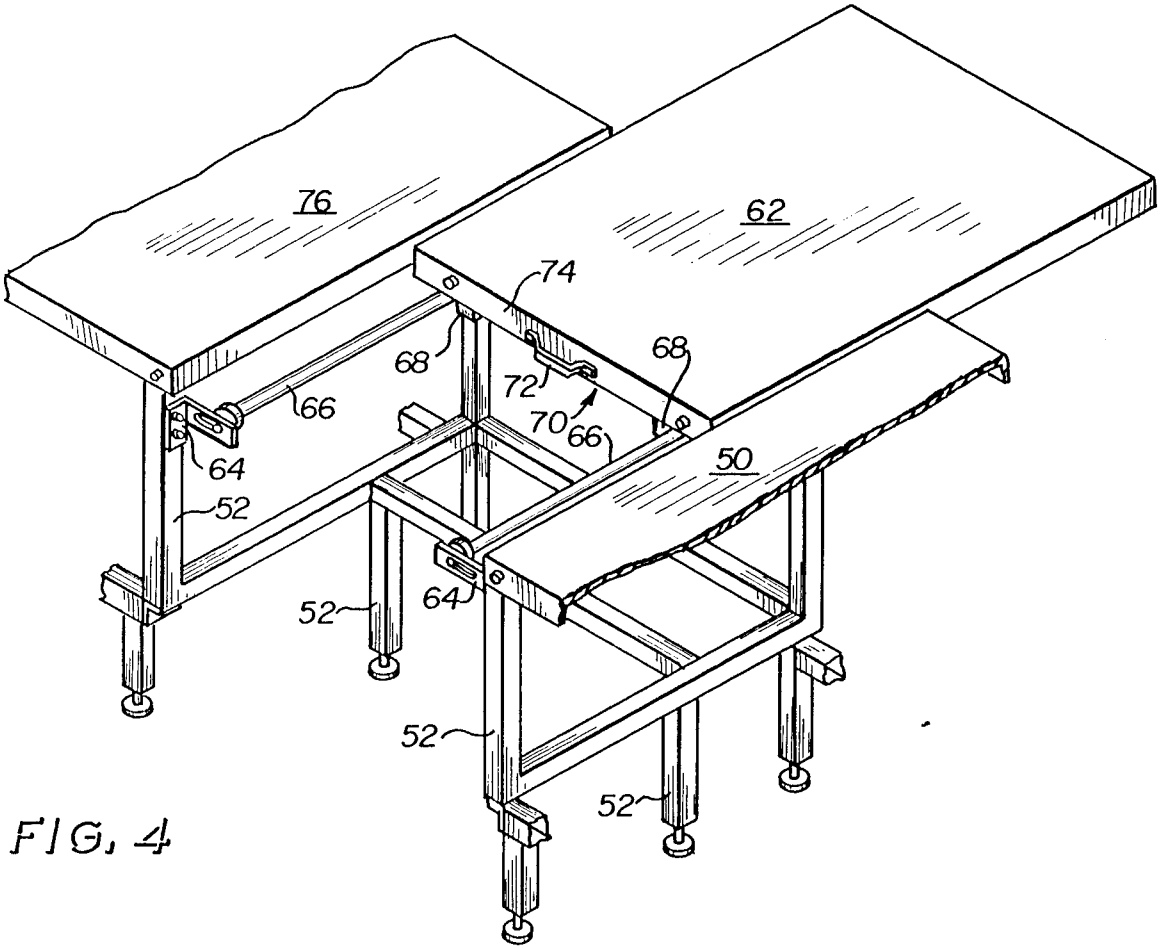
FIG. 4 is a perspective view of a sliding table of the bagger.

In addition, the table assembly 20 includes a sliding table 62 positioned directly downstream of and coextensive with the outfeed table plate 50. As most clearly illustrated in FIG. 4, the sliding table 62 is movably supported by the vertical and horizontal frame members 52, 36 of the table assembly 20 for horizontal, lateral movement with respect to the outfeed table plate 50. Specifically, as shown in FIGS. 3 and 4, the sliding table 62 is movably mounted adjacent to the outfeed table plate 50 by two pairs of L-shaped brackets 64 rigidly secured to two pairs of vertical frame members 52 supporting the sliding table, with each pair of vertical frame members aligned transversely of the bagger 10. Two pairs of mounting rods 66 are securely mounted to and between each pair of transversely aligned L-shaped brackets, and a pair of bearings 68, secured to a bottom side 70 of the sliding table, are slidably mounted to the mounting rods 66. In this manner, as shown in FIG. 4, an operator is able to move the sliding table 62 laterally out of registry with the outfeed table plate 50 to allow the operator to position himself/herself adjacent and directly downstream of the outfeed table plate to perform specific tasks associated with operation of the bag holder assembly 25. For this purpose, the sliding table 62 includes a handle 72 secured to each lateral side 74 of the sliding table for facilitating lateral movement of the same. The operation of the sliding table 62 and the task to be performed incident to the bagging of the bottles, will be hereinafter explained in detail in connection with a discussion of the overall operation of the bagger 10.

Figure 1B:
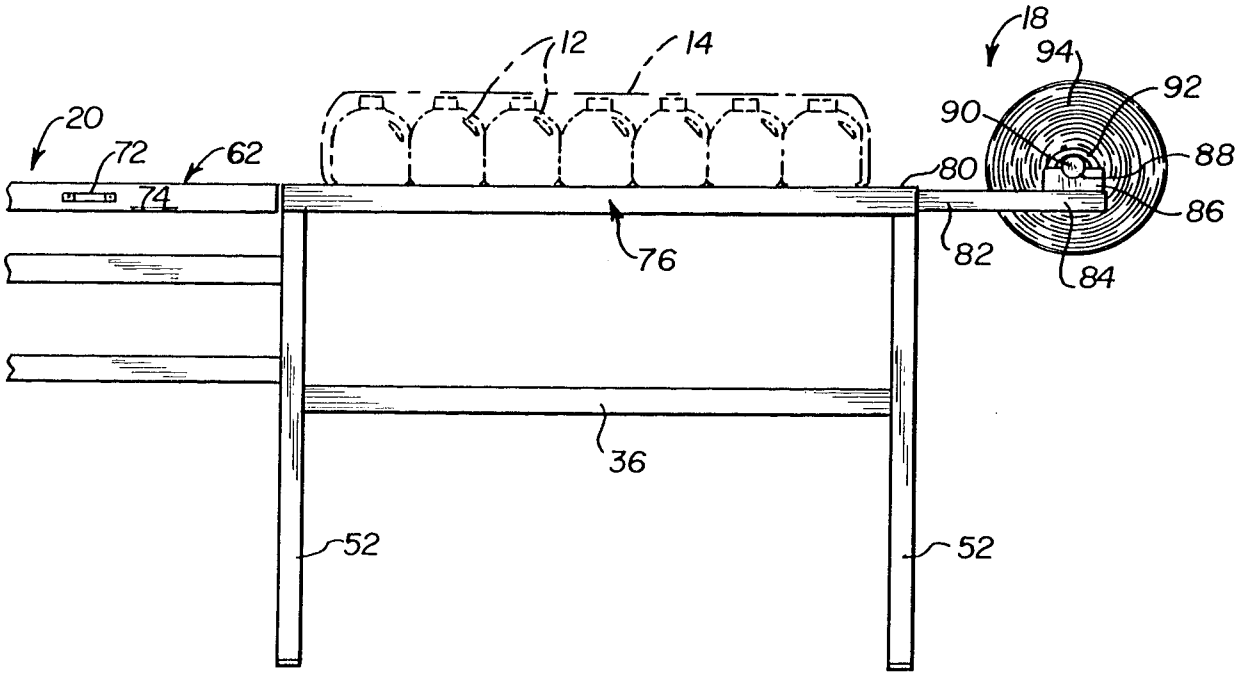
FIG. 1B is a side, elevational view of a downstream portion of the bagger.
Figure 2B:
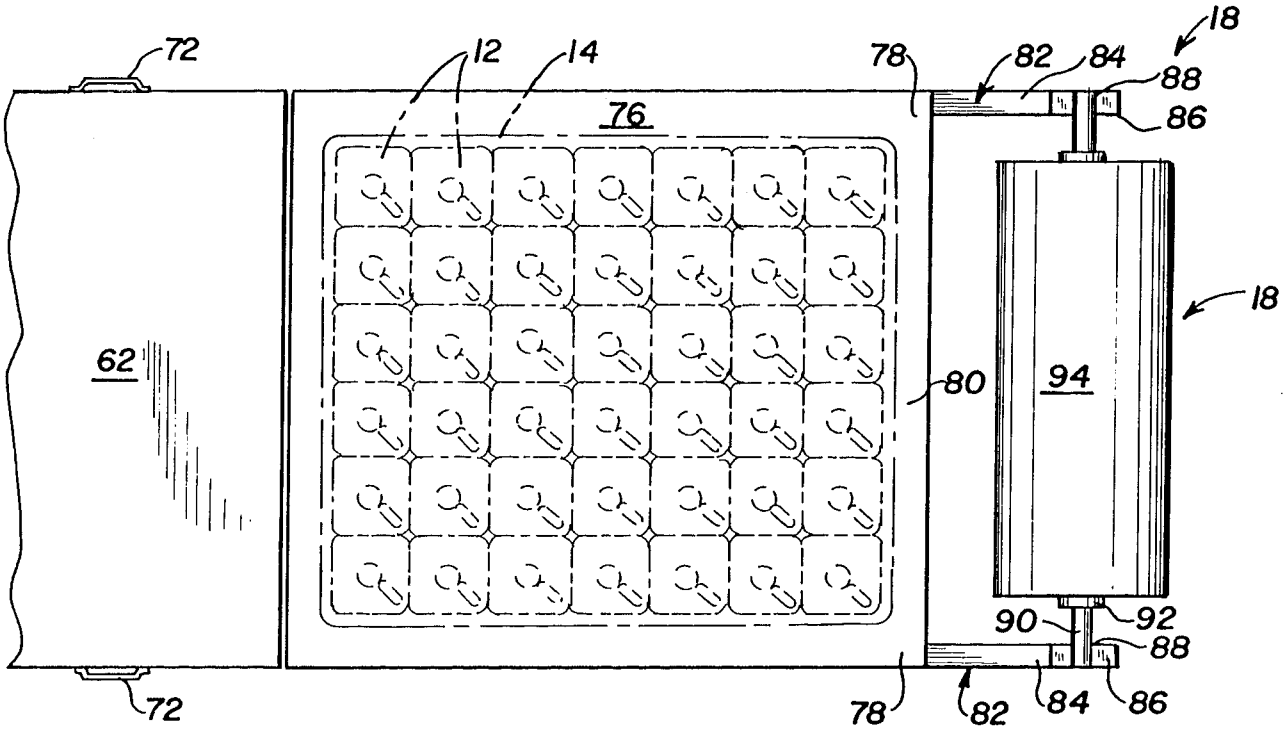
FIG. 2B is a plan view of the downstream portion of the bagger.

As seen in FIGS. 1B and 2B, the table assembly 20 further comprises an outfeed table 76 supported by vertical and horizontal frame members 52, 36 of the table assembly and positioned directly downstream of and coextensive with the sliding table 62. The outfeed table 76 has rigidly secured to outside portions 78 of the downstream axial side 80 of the outfeed table a pair of stanchions 82 having securely attached to the outboard ends 84 thereof a pair of support blocks 86. The support blocks 86 include sockets 88 in which a spool 90 is securely seated and rotatably supports a hollow roller 92 around which is wrapped a roll 94 of plastic bags 14.

The pusher assembly 22 is best illustrated in FIGS. 1A, 2A and 3 and comprises a drive cylinder 96 rigidly connected to and between upstream and downstream, horizontal frame members 98, 100 of the table assembly 20, wherein the upstream, horizontal frame member is secured to and between the pair of upstream, vertical frame members 32 and the downstream, vertical frame member is secured to and between the pair of downstream, vertical frame members 34. Specifically, the drive cylinder 96 is secured to and between central portions 102 of the upstream and downstream, horizontal frame members 98, 100. In this manner, the drive cylinder 96 is supported above and extends parallel with a central, longitudinal axis of the infeed table 26. The drive cylinder 96 is preferably pneumatic and houses a piston (not shown) for slidable movement along the full length of the drive cylinder. An example of a suitable drive cylinder is an Origa Cylinder Series 200 manufactured by Origa Corporation of Elmhurst, Illinois.

In addition, the pusher assembly 22 includes a pair of guide shafts 106 securely connected to and between the upstream and downstream, horizontal frame members 98, 100, and equidistantly spaced from and positioned on opposite sides of the drive cylinder 96. Specifically, each guide shaft 106 includes upstream and downstream sides 108, 110 secured to flange plates 112 rigidly secured to and depending downwardly from the upstream and downstream, horizontal frame members 98, 100. In addition, each guide shaft 106 slidably mounts a ball bushing 114. The ball bushings are securely connected together for synchronized slidable movement along the guide shafts by a connecting plate 116. The piston (not shown) is securely connected to the connecting plate 116 by a connecting bracket 118 secured to the piston, set in registry with an elongated channel 120 in a wall 122 of the drive cylinder 96 and mounted to and between the piston and a central part 124 of the connecting plate. In addition, the pusher assembly 22 includes a pair of pusher frames 126 rigidly secured at upstream ends 128 thereof to the connecting plate 116, on opposite sides of and equidistantly spaced from the same. Lower, downstream ends 130 of the pusher frames 126 are secured to a pusher paddle 132 slidably supported on the infeed table 26. In this manner, as the piston (not shown) moves along the length of and within the drive cylinder 96, the pusher paddle 132, connected to the piston by the connecting bracket and plate 118, 116 and the pusher frames 126, will slide along the infeed table 26 in synchronized movement with the piston.

The pusher paddle 132 is a substantially flat, vertical member positioned across and having a length substantially equal to the width of the infeed table 26. The pusher paddle 132 also has a rearwardly extending flange 134 on a longitudinal axial edge 136 of the paddle corresponding to that longitudinal side 42 of the infeed table 26 to which the infeed conveyor 44 is attached. The flange 134 extends upstream a predetermined distance and functions to block movement of the bottles 12 onto the infeed table 26 during most stages of operation of the pusher assembly.

In addition, as shown in FIGS. 1A and 2A, a stop gate 138 is provided to block the loading of bottles 12 onto infeed table 26 in those stages of operation of the pusher assembly 22 in which the paddle flange 134 is unable to do so. The stop gate 138 is movably mounted to the horizontal frame member 36 to which the conveyor 44 is attached. Movement of the stop gate 138 is controlled by a first cylinder 140 which drives the stop gate in front of the infeed conveyor 44 to interfere with movement of bottles 12 onto the infeed table 26.

The pusher assembly 22 also includes three reed switches, RS-1, RS-2 and RS-3, mounted to the wall 122 of the drive cylinder 96, at predetermined spaced intervals on the wall, by fasteners 141 securely mounted to the drive cylinder 96. As discussed below, the reed switches function to detect the position of the piston (not shown) housed within the drive cylinder 96 during operation of the pusher assembly 22.

As illustrated in FIGS. 1A, 2A and 3, the bag holder assembly 25 is mounted to the downstream, vertical frame members 34, above and below the downstream end 30 of the infeed table 26, the horizontal frame members 36 and a horizontal support 142 mounted between the downstream, vertical frame members 34. The bag holder assembly comprises a pair of buckets 144 and a pair of clamp feet 146. Specifically, the horizontal support 142 is an elongated rod-like member rigidly secured to and between the downstream vertical frame members 34 above the downstream end 30 of the infeed table 26. Each downstream, vertical frame member 34 has mounted thereto, above the infeed table 26, a lower cylinder bracket 148, an upper hinge link 150 mounted above the lower cylinder bracket and a second cylinder 152 mounted to and between the cylinder bracket and an upstream part 154 of the hinge link 150. A mounting rod 156 is rotatably mounted, at an outer end 158 thereof, to a downstream part 160 of the hinge link 150 and can be actuated for pivotal movement about pivot axis 162 through operation of the second cylinder 152. An inner end 164 of the mounting rod 156 is rotatably mounted to the horizontal support 142 through a pair of bucket hinge supports 166. In this manner, the buckets 144 are adapted to pivot vertically with rotation of the mounting rods upon actuation of the second cylinders 156 through the hinge links 150.

As stated above, the bag holder assembly 25 also includes a pair of clamp feet 146, with each clamp foot movably mounted, below the downstream end 30 of the infeed table 26, to a horizontal frame member 36 to which the infeed table is rigidly secured. Specifically, at each longitudinal side 42 of the infeed table 26, a clamp 168 is rigidly secured to a downstream axial end 170 of the horizontal frame member 36, a third cylinder 172 is mounted to the clamp 168 and the clamp foot 146 is secured to the third cylinder and positioned directly underneath the infeed table. The clamp foot 146 is adapted for movement into and out of secure engagement with a bottom surface 174 of the infeed table 26 through the third cylinder 172.

As will be hereinafter explained in detail, the buckets 144 and the clamp feet 146 function to hold a bag 14 in an open position so that the pusher paddle 132 can force several rows of bottles 12 from the infeed table 26 into the bag positioned on the sliding and outfeed table 62, 76.

The sealing assembly 24 is illustrated in FIGS. 1A and 2A and, as stated above, is positioned in space 60 between the infeed table plate 48 and the outfeed table plate 50 and includes a sealing jaw frame 76. The sealing jaw frame 176 is a rectangular frame member comprising a pair of vertical frames 178 and upper and lower, horizontal frames 180, 182, with the lower, horizontal frame 182 rigidly secured to vertical and horizontal frame members 52, 36 of the table assembly 20 so as to support the sealing jaw frame in the space 60 and between the infeed and outfeed table plates 48, 50. A pair of poles 184 are mounted to and between the upper and lower, horizontal frame members 180, 182, at the outer ends 186 of the sealing jaw frame 176.

In addition, the sealing assembly 24 includes a lower sealing jaw assembly 188 and an upper sealing jaw assembly 190. The lower sealing jaw assembly 188 includes a lower sealing jaw 192 movably mounted to and between the poles 184 by a pair of second bearings 194 secured to outer sides 196 of the lower sealing jaw and positioned substantially even with the infeed and outfeed table plates 48, 50 in its open position illustrated in FIG. 1. The lower sealing jaw 192 is adapted to slide upwardly from an open position to a closed position in contact with the upper sealing jaw assembly 190. The lower sealing jaw 192 is driven by a fourth cylinder 197 secured to the lower, horizontal frame 182 of the sealing jaw frame 176. The upper sealing jaw assembly 188 includes an upper sealing jaw 198 slidably mounted to and between the poles 182 by a pair of third bearings 200 mounted to outer parts 202 of the upper sealing jaw 198. The upper sealing jaw 198 is adapted to move vertically from the open position illustrated in FIG. 1 to a clamping position in contact with the lower sealing jaw 192. The upper sealing jaw 98 is driven by a fourth cylinder 204 secured to the upper, horizontal frame 180 of the sealing jaw frame 76. Specifically, the fourth cylinder 204 is mounted to a central portion 206 of the upper, horizontal frame 80 and includes a piston-driven arm 208 which extends through the upper, horizontal frame and is mounted to a two-piece bracket 210 secured to a central area 212 of the upper sealing jaw 198. The upper and lower sealing jaws 192, 198 include a opposed sealing jaw bars 214. The bars are preferably made of machined aluminum.

The sealing jaw assembly 24 functions to seal a bag 14 closed and at the same time sever excess material of the bag upstream of the seal after the bag has been filled with numerous rows of bottles 12. To this end, the sealing assembly 24 includes a heater element (not shown) comprising thin, metal band 248 mounted to an opposing surface 216 of one of the bars 214. A cold wire (not shown) is mounted to the surface 216 of the other bar 214. Teflon strips (not shown) are mounted to the bars to insulate the band 248 and the cold wire (not shown) from the aluminum bars 214. When the upper and lower sealing jaws 198, 192 are moved from the open position to the clamping position, the open end of the bag 14 is closed and held firmly in place by the bars 214 and then a thermal impulse is produced in the heater element (not shown). The heat produced seals the open end of the bag and the cold wire against the heater element severs excess plastic from the bag upstream of the seal. Suitable sealing jaw bars are manufactured by Vertrod Inc., of Brooklyn, N.Y.

As a safety feature, the upper and lower sealing jaws 198, 192 are first driven by the fourth and fifth cylinders 197, 204 from their open positions to their clamping positions under low pressure, approximately 20 p.s.i. Under such force, the upper and lower sealing jaws 198, 192 will not cause injury to an operator who inadvertently causes an obstruction, such as his/her limb, to be positioned between the upper and lower sealing jaws during operation of the sealing jaw assembly 24. Once the bars 214 of the upper and lower sealing jaws 192, 198 are set in closed engagement, LS-2 and LS-3 signal the controller 322 to cause the jaws exert a greater force on each other, approximately 80 p.s.i. and electric current is applied to the heater element (not shown), resulting in sealing and severing of the plastic bag.

The bottle bagger 10 further includes a pair of horizontal doors 218 pivotably secured to a horizontal transverse frame member 220 of the bagger 10 secured to and between horizontal frame members 36 on opposite sides 42 of the bagger. The doors 218 extend transversely across substantially the full width of the upstream part 16 of the bagger 10 and are positioned above the pusher assembly 22. The doors 218 cover the elements of the pusher assembly 22 and the infeed table 26 to prevent dust from accumulating on the same and allow access to the elements of the pusher assembly for service and repair. As a safety feature, the bagger 10 includes a limit switch LS-4 positioned adjacent the doors and which signals the controller to cease operation of the pusher assembly when either of the doors 218 are opened.

Figure 5:
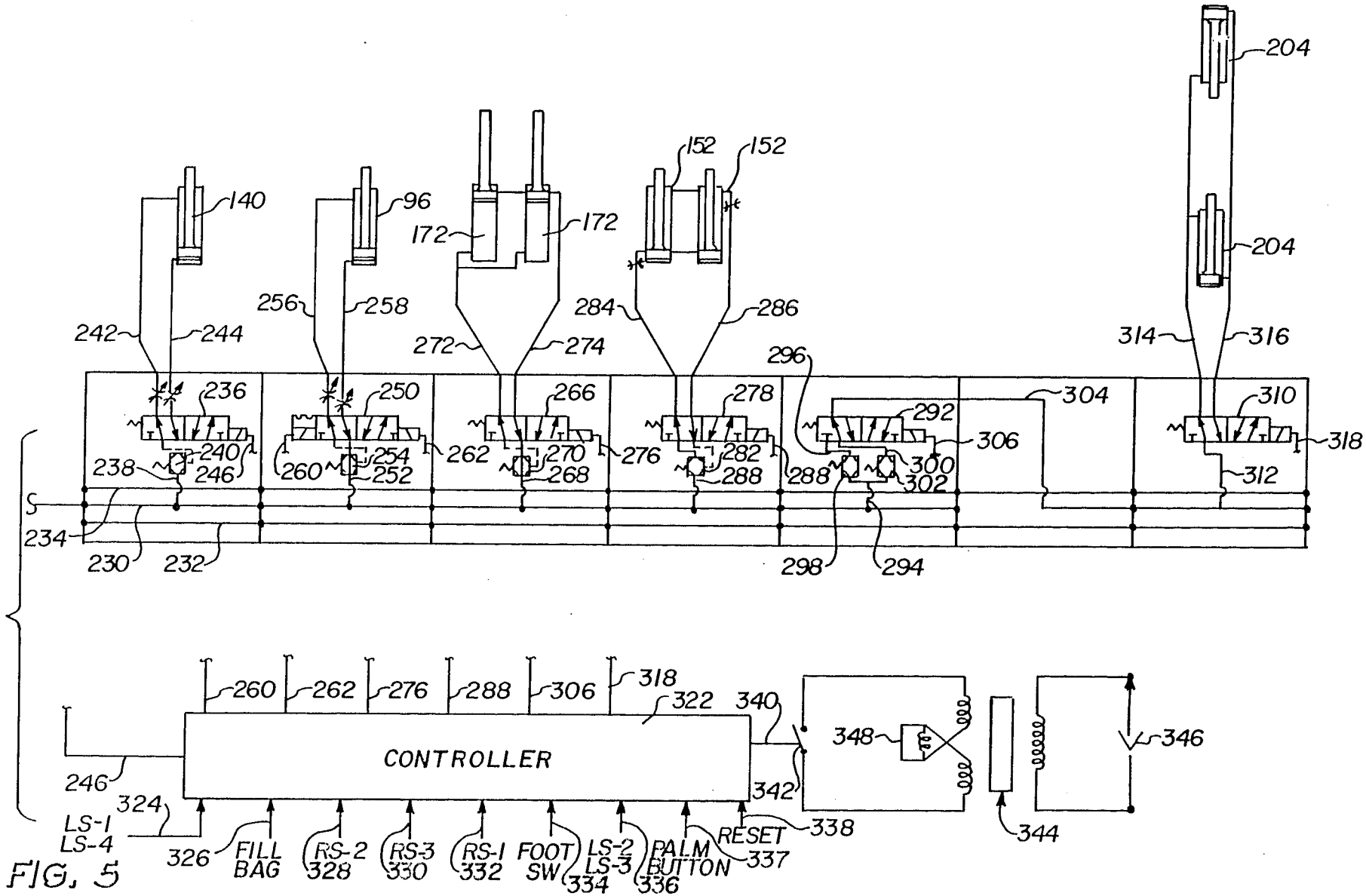
FIG. 5 is a schematic representation of a control system employed in the operation of the bagger.

Referring now to FIG. 5, there is shown a schematic of a control system used to operate the bagger 10 and comprising a fluid pressure line 230 connected to a source of fluid pressure and exhaust lines 232 and 234 connected to atmosphere. The fluid pressure source preferably is a source of pressurized air.

A solenoid-operated spool valve 236 is connected to the fluid pressure line 230 through an input line 238 and a regulator valve 240. An outlet line 242 having a flow control valve is connected between the valve 236 and one end of the first cylinder 140. Another outlet line 244, also have a flow control valve, is connected between the valve 236 and another end of the first cylinder 140. An electrical control line 246 operates the solenoid of the solenoid-operated spool valve 236 to shift the valve between two operative positions. In one position, pressurized fluid is directed from the input line 238 to the outlet line 242 to drive the push rod of the first cylinder 140 in one direction, while at the same time the outlet line 244 is connected to exhaust line 234. Alternatively, when the valve is switched to the other operative position, the input line 238 is connected to the outlet line 244 to drive the push rod in an opposite direction, and the outlet line 242 is connected to exhaust line 232.

A solenoid-operated spool valve 250 is connected to the fluid pressure line 230 through an inlet line 252 and regulator valve 254. An outlet line 256 and an outlet line 258 are connected alternatively to opposite ends of the drive cylinder 96. Both outlet lines 256, 258 have flow control valves. The outlet lines 256, 258 alternatively are connected to he exhaust lines 232, 234, respectively. An electrical-control line 260 controls the movement of the valve in one direction and an electrical-control line 262 controls the movement of the spool valve in an opposite direction. The operation of the spool valve 250 is the same as the operation of spool valve 236 except that the spool valve 250 is driven in opposite directions by solenoids at either end of the spool valve in spool valve 250, whereas in valve 236 a single solenoid drives the spool valve in one direction and a spring biases the spool valve in an opposite direction.

A solenoid-operated spool valve 266 is connected to the fluid pressure line 230 through an inlet line 268 and a regulator valve 270. An outlet line 272 and an outlet line 274 are connected alternatively to opposite ends of the third cylinders 172, depending on the position of the spool valve. Also, the outlet lines 72, 274 are connected to either the exhaust line 232 or the exhaust line 234, respectively. An electrical-control line 276 controls the operation of the solenoid in the spool valve 266. The operation of the solenoid-operated spool valve 266 is the same as the operation of the spool valve 236.

A solenoid-operated spool valve 278 is connected to a fluid pressure line 230 through an inlet line 280 and a regulator valve 282. Outlet lines 284, 286 are connected to opposite ends of the second cylinders 152 and selected outlets from the spool valve 278. The outlet lines 284 and 286 are likewise connected alternatively to the exhaust line 232 and the exhaust line 234, respectively. The position of the spool in the spool valve 278 is controlled by a solenoid which is energized through an electrical control line 288.

A solenoid-operated spool valve 292 is connected to the fluid pressure line 230 through an inlet line 294, a first branch line 296 and regulator valve 298 and a second branch line 300 and regulator valve 302. An outlet line 304 is connected to the valve to receive pressure from either the second branch line 300 or a combination of the first branch line 296 and the second branch line 300. The position of the spool in the spool valve 292 is controlled by a solenoid energized through an electrical-control line 306. The solenoid-operated spool valve 392 operates to supply fluid pressure to line 304 at two different pressure levels, depending on the position of a spool in the spool valve 292.

A solenoid-operated spool valve 310 is connected to the fluid pressure line 230 through an inlet line 312. An outlet line 314 is connected to one end of the fourth and fifth cylinders 197, 204 and an outlet line 316 is connected to another end of the fourth and fifth cylinders. The outlet lines 314 and 316 are connected either to the pressure line 312 through the spool valve 310 or to an exhaust line. The outlet line 314 connects to the exhaust line 232 and the outlet line 316 connects to the exhaust line 234. An electrical control line 318 controls the solenoid in the spool valve 310.

A controller 322 is provided to control the spool valves 236, 250, 266, 278, 292 and 310. The controller 322 can be a hard wire control mechanism or a programmable controller as understood by those having skill in the program control art. Further, the controller 322 controls the energization of the wires 348 of the heater element (not shown). The controller 322 receives inputs from LS-2 and LS-3 through input line 324, from a bottle fill switch (not shown) through input line 326, from RS-2 through input line 326, from RS-3 through input line 330, from RS-1 through input line 332, from LS-2 and LS-3 through input line 336 and from a reset switch (not shown) through input line 338. The controller has outputs 340 and 342 for the wires 348 of the heater element (not shown).

The wire output 340 is connected to a switch 342 in an electrical circuit with the wires 348 and transformer 344. A voltage source 346 supplies power to a primary coil (not shown) of the transformer 344. Upon closing of the switch 342, the transformer will generate current in thewires 348 in the wire circuit.

The operation of the bagger 10 will now be described with reference to all of the Figures. With respect to operation of the controller 322, reference should be made specifically to FIG. 5.

To fill a bag 14 with a plurality of rows of bottles 12 and thereafter seal the bag, the operator first positions the bag 14 on the bag holder assembly 25 by first unrolling and removing the bag 14 from the roll 94 and placing the bag on the outfeed table 76 with the open end of the bag positioned upstream. The operator then moves the sliding table 162 laterally of the outfeed table plate 50 to allow the operator to position himself/herself directly downstream of the same. Subsequently the operator presses a foot switch (not shown) which provides an input to the controller 322 through the input line 334. The controller 322 will then generate output signals in electrical-control lines 276, 288 to drive spool valves 266, 278, respectively, so that the push rods of the third cylinders 172 will be retracted and the push rods of the second cylinders 152 will be extended. The retraction of the push rods of the third cylinders 172 drops the clamp feet 146. The extension of the push rods of the second cylinders 152 pivots the buckets 144 downwardly.

With the operator maintaining pressure on the foot switch, the operator then feeds the lower portion of the open end of the bag 14 through the slot 58, between the downstream end 30 of the infeed table 26 and the infeed table plate 48, and positions the lower portion of the bag between the bottom side 174 of the infeed table 62 and the clamp feet 146. The operator then releases the foot switch (not shown) which causes the controller 322 to immediately send a signal to the solenoid of the spool valve 266 through control line 276 to shift the spool valve to the opposite position to drive the push rods of the third cylinders 172 upwardly to raise the clamp feet 146 to thereby securely sandwich and hold the lower portion of the open end of the bag 14 between the bottom side 174 of the infeed table 62 and the clamp feet 146. While remaining substantially downstream of the outfeed table plate 50, the operator then places the upper portion of the bag 14 over the buckets 144. In the event that salvage from a previous bag remains positioned on the buckets and beneath the infeed table, the salvage is first removed before a new bag is positioned on the buckets and beneath the infeed table as described above.

The controller 322 shortly thereafter sends a signal through control line 288 to the solenoid of the spool valve 278 to retract the push rods of the second cylinders 152 to raise the buckets 144. In this manner, the open end of the bag 14 is held wide open between the bottom side 174 of the infeed table 26 and the buckets 144.

Subsequently, the operator slides the sliding table 62 back to the position aligned directly downstream of the outfeed table plate 50. In this manner, the open end of the bag is held wide open by the clamp feet 146 and the buckets 144 and is thus able to receive rows of bottles 12 to be pushed from the infeed table 26 to within the bag by the pusher assembly 22.

In operation of the pusher assembly 22, the piston (not shown) is set in its most upstream position adjacent to reed switch RS-1 and the pusher paddle 132, connected to the piston by the pusher frames 126, is set slightly upstream of the infeed conveyor 44. When the piston and the pusher paddle are so positioned, the conveyor 44 feeds bottles 12 seriatim onto the infeed table 26. The bottles 12 are forced in single file transversely across the infeed table 26 by each succeeding bottle fed onto the infeed table. When the first bottle fed onto the infeed table 26 (hereinafter, the "leading bottle") reaches the right, longitudinal side 42 of the same from the viewpoint of the upstream part 16 of the bottle bagger 10 looking downstream, the leading bottle will contact a first limit switch LS-1. LS-1 provides an input on limit switch input line 336 to the controller 322 which pulses the solenoid through control line 262 to drive the push rod of the drive cylinder 96 and the pusher paddle 132 downstream until the piston (not shown) reaches a position in the drive cylinder adjacent reed switch RS-2. RS-2 then signals the controller 322, through input line 328, to pulse the solenoid valve 250 through the electrical control line 268 to thereby cause the piston (not shown) to stop and retract to a position adjacent RS-1. By this operation, the pusher paddle 132 forces a first row of bottles 12 downstream approximately six inches, a sufficient distance to enable another row of bottles to be fed onto the infeed table by the conveyor 44 directly upstream of the first row. When the piston (not shown) is positioned adjacent RS-2, the flange 134 of the paddle 132 is disposed directly in front of the infeed conveyor 44 to thus prevent further movement of bottles therefrom onto the table 26. If bottles were allowed to be fed onto the infeed table 26 at this time, they would be loaded thereon upstream of the paddle 132. In this position, the bottles 12 would not be in a position to be pushed downstream by the pusher paddle 132 for eventual loading within the bag 14. When the piston (not shown) retracts, the flange 134 moves upstream and out of interference with the movement of bottles 12 onto the infeed table 26.

When another row of bottles 12 is allowed to accumulate on the infeed table 26, the leading bottle 12 of the second row contacts the LS-1, which again signals the controller to move the piston (not shown), the pusher paddle 132 and the second row of bottles 12 downstream and then retract the piston to a position adjacent RS-1. This process will go through a predetermined number of cycles until a predetermined number of rows of bottles 12 are positioned on the infeed table 26. Each time the piston (not shown) slides between RS-1 and RS-2, a pulse is applied to the controller. After a predetermined number of counts, the controller signals the solenoid valve 250 through control line 268 to cause the piston (not shown) to stop and retract to a position adjacent RS-1. At this time, the operator may not have completely finished placing the bag 14 on the bag holder means 25. When the operator has completed this task, the operator presses a bag fill switch (not shown) which signals the controller 322, through input line 326, to pulse the solenoids for valves 236 and 256 to drive the piston (not shown) and the pusher paddle 132 downstream until the piston is positioned in the drive cylinder 96 adjacent reed switch RS-3. Thereafter, downstream movement of the piston (not shown) stops and the piston retracts to the position adjacent RS-1. In this manner, the rows of the bottles 12 are pushed across the infeed table plate 48, into the open end of the bag 14 positioned on the bag holder assembly 25 and across the upper and lower sealing jaws 198, 192.

When the pusher paddle 132 is moved to the downstream end 30 of the infeed table 26, the flange 134 of the paddle is not in a position to prevent movement of bottles 12 onto the infeed table 26. At this time, the controller actuates the first piston 140 to slide the stop gate 138 downstream and in front of the conveyor 44 to thus prevent further movement of bottles onto the infeed table 26. Specifically, the controller 322 pulses the solenoid in spool valve 236, through electrical control line 246, to cause the push rod of the cylinder 140 to retract to thereby move the stop gate 138 into a blocking position. In addition, when the piston is moved back to the position adjacent RS-1, rows of bottles are then allowed to accumulate on the infeed table 26 and subsequently the rows are pushed into another bag 12 in the identical manner as described above.

When the piston (not shown) is retracted upstream from its position adjacent RS-3 to the position adjacent RS-1, the operator pushes two palm buttons (not shown) which signal the controller 322, through input lines 377, to operate the fourth and fifth cylinders 197, 204 to drive the upper and lower sealing jaws 198, 192 together to seal the open end of the bag 14 and sever excess material of the bag upstream of the seal. Specifically, the controller 322 sends a signal to the valve 294 through the line 306 to drive the spool so that the line 304 receives pressure only from the second branch line 300. At the same time, the controller 322 pulses the solenoid for valve 310 to move the spool so that the input line 312 is connected to the output line 316 to drive the sealing jaws 192, 198 together. Note that at this time, a relatively low pressure is driving the sealing jaws together. Thus, as stated previously, in the event that an operator's arm is positioned between the jaws, little or no damage will occur to the operator. When the jaws are together, the controller 322 pulses the solenoid for the spool valve 392, through control line 306, to shift so that the outlet line 304 receives the pressure from both the first branch 296 and the second branch 300, thereby applying greater pressure to the cylinders 197, 204. The sealing jaws 192, 198 are thus tightly clamped together. At this time, the controller 322 will pulse the wires 340 and 342 to seal and sever the bag.

When the sealing jaws 192, 198 are brought together, LS-2 and LS-3 will be actuated, thereby sending a signal to the controller 322. The controller 322 has a timing system which performs a timing function which is started when the sealing jaws 192, 198 are positioned in the clamping position. In order for the controller 322 to activate the wire outputs 340 and 342, the controller must receive input signals from LS-2 and LS-3 before the timer times out. If the timer times out before an input signal from LS-2 and LS-3, the controller 322 will send a signal through control line 318 to shift the spool in the spool valve 310 to retract the fourth and fifth cylinders 197, 204. Thus, the sealing jaws 192, 198 open automatically in the event that LS-2 and LS-3 are not activated within a predetermined period of time after the jaws begin to close. This feature prevents the jaws from clamping on an operator for an extended period of time and provides an automatic release in the event that an obstruction is positioned between the clamping jaws. Further, the electrical current for the wires 348 is not actuated in the event that the jaws do not meet and LS-2 and LS-3 are not actuated.

In addition, in order for the controller 322 to operate the wires 348 through the outputs 340 and 342, the operator must have pushed the two palm buttons (not shown) previously mentioned to close the sealing jaws 192, 198 to activate LS-2 and LS-3 which then provide an input through input lines 337. Thus, the bagger 10 provides a safety feature in that both palm buttons (not shown) must also be pushed before the sealing function is actuated by the controlled 322.

The bagger 10 contains another safety feature in that the doors 218 must be closed before the operation can commence. Limit switch LS-4 detects the position of the door in the closed position. When the doors are in the closed position, LS-4 will send a signal to the controller 322 through LS-4 input line 324.

A bottle fill input (not shown) is provided when the operation is to be started. This input is provided to the controller 322 through the bottle fill input line 326.

Finally, if for some reason the counter (not shown) is out of sequence with the number of rows of bottles which have been pushed on the infeed table 26 between RS-1 and RS-2, the operator can reset the counter and start the cycle anew by pressing a reset button (not shown). Specifically, the reset button signals the controller through input line 338 to reset the counter.

While the invention has been described in connection with the preferred embodiment, it will be understood that I do not intend to limit the invention to that embodiment. To the contrary, I intend to cover all alternative modifications and equivalents as may be included within the spirit and scope of the invention as defined by the appended claims.

I claim:

1. In an apparatus for packaging articles into a bag having an open end, said apparatus comprising a table for supporting said articles and having an upstream portion and a downstream portion, a conveyor means for feeding said articles seriatim onto said upstream portion so as to form a row of said articles on said table, a bag holder means for supporting said open end of said bag on a said table such that said open end faces said upstream portion, a pusher means for forcing said row of said articles from said upstream portion to said downstream portion and into said bag through said open end of said bag, a sealing means for sealing said open end of said bag, and a control means for successively moving said pusher means a relatively short distance on said upstream portion of said table to move individual rows of said articles downstream to accumulate a predetermined number of said rows on said upstream portion of said table, and for pushing said accumulated predetermined number of rows into said bag, the improvement in said control means comprising:

a counter means for counting said relatively short distance movements of said pusher means, and a first actuating means connected to said counter means and for actuating movement of said pusher means to said downstream portion of said table to push said accumulated rows into said bag after a predetermined number of relatively short distance movements counted by said counter means.

2. An apparatus according to claim 1, and further comprising a first detection means for detecting the presence of said individual rows of said articles on said upstream portion of said table; and said control means is operatively connected to said first detection means and responds to the detected presence of said individual rows on said table to move said pusher means and thus said individual rows downstream said relatively short distance on said table.

3. An apparatus according to claim 2, and further comprising a second detection means for detecting the movement of said pusher means said relatively short distance on said table; and said control means is operatively connected to said second detection means and responds to the detected movement of said pusher means said relatively short distance to move said pusher means upstream to an initial position.

4. An apparatus according to claim 3, and further comprising a third detection means for detecting the presence of said pusher means at said initial position on said table.

5. An apparatus according to claim 4, wherein said control means further comprises an interlock means operatively connected to said counter means and responsive to said predetermined number of counts of said counter means for disabling said first actuating means to prevent said pusher means from moving from said initial position; and a manually operated fill switch means operatively connected to said first actuating means for releasing said interlock means and activating said actuating means to move said pusher means from said initial position to said downstream portion of said table to push said accumulated rows of said articles into said bag.

6. An apparatus according to claim 5, and further comprising a fourth detection means for detecting the movement of said pusher to said downstream portion of said table; and said control means is operatively connected to said fourth detection means and is responsive to the detected movement of said pusher means to said downstream table portion to move said pusher means upstream to said initial position on said table.

7. An apparatus according to claim 6, wherein said control means further comprises a resetting means operatively connected to said fourth detection means and said counter means and responsive to the movement of said pusher means to said downstream portion of said table for resetting said counter means.

8. An apparatus according to claim 8, wherein said pusher means further comprises a first interference means for interfering with seriatim feeding of said articles onto said table by said conveyor means when said pusher means is moved said relatively short distance on said table.

9. An apparatus according to claim 8, and further comprising a second interference means movably mounted on said upstream portion for interfering with seriatim feeding of said articles onto said table by said conveyor means when said pusher means is moved to said downstream portion; and said controller means is responsive to movement of said pusher means to said downstream portion to move said second interference means into a position of interference with feeding of said articles onto said table when said pusher means is moved to said downstream table portion.

10. An apparatus according to claim 9, wherein said sealing means comprises a pair of opposed sealing jaws positioned adjacent to said open end of said bag; and means for mounting said sealing jaws for movement between an open position where said jaws are positioned in spaced-apart relationship and a clamping position where said jaws engage one another; and said control means further comprises a second actuating means for moving said sealing jaws from said open position to said clamping position under a first pressure when said pusher means moves from said downstream portion to said initial position.

11. An apparatus according to claim 10, wherein said control means further comprises a manually operated palm button means operatively connected to said second actuating means for activating said second actuating means to move said sealing jaws from said open position to said clamping position under said first pressure.

12. An apparatus according to claim 11, and further comprising a fifth detection means for detecting the presence of said sealing jaws in said clamping position; and said control means is operatively connected to said fifth detection means and responds to the detected presence of said sealing jaws in said clamping position to drive said sealing jaws together under a second pressure greater than said first pressure.

13. An apparatus according to claim 12, wherein said sealing means further comprises a thermal severing means for applying heat to said open end of said bag to seal said bag and sever excess material from said bag at said seal; and said control means is further responsive to the detected presence of said sealing jaws in said clamping position to activate said thermal severing means to apply heat to said bag.

14. An apparatus according to claim 13, wherein said control means further comprises a first timer means operatively connected to said fourth detection means and responsive to the detected movement of said pusher means to said downstream portion of said table for measuring a first predetermined time period; and is further responsive to said first timer means to move said jaws to said open position when said first time period ends prior to the detection of said jaws in said clamping position by said fifth detection means.

15. An apparatus according to claim 14, wherein said sealing jaws are driven under said first pressure and said second pressure at approximately 20 p.s i. and 80 p.s.i., respectively.

16. An apparatus according to claim 14, wherein said open end of said bag further comprises an upper portion and a lower portion; and said bag holder means is positioned upstream of said sealing means and comprises an upper holder means for holding said upper portion above said table and a lower holder means for holding said lower portion below said table.

17. An apparatus according to claim 16, wherein said lower holder means further comprises feet means movable between a bottom position where said feet means are out of engagement with said table and a top position where said feet means engage said table for securely clamping said lower portion of said bag between said table and said feet means; and said upper holder means further comprises bucket means pivotal between a lower position where said bucket means is adapted to receive said upper portion of said bag and an upper position where said bucket means securely holds said upper portion of said bag above said table.

18. An apparatus according to claim 17, wherein said control means comprises a third actuating means for actuating movement of said feet and bucket means between said bottom and lower positions and said top and upper positions, respectively; and a manually operated foot switch means operatively connected to said third actuating means and for activating said third actuating means to move said feet and bucket means to said bottom and lower positions, respectively, when said foot switch means is activated and to move said feet and bucket means to said top and upper positions, respectively, when said foot switch means is deactivated.

19. An apparatus according to claim 18, wherein said control means further comprises a second timer means operatively connected to said foot switch means and for measuring a second predetermined time period when said foot switch means is deactivated; and is further responsive to said second timer means to move said bucket means to said upper position at the expiration of said second time period.

20. An apparatus according to claim 1, wherein said sealing means comprises a pair of opposed sealing jaws positioned adjacent to said open end of said bag; and a means for mounting said sealing jaws for movement between an open position where said jaws are positioned in spaced-apart relationship and a clamping position where said jaws engage one another; and said control means further comprises an actuating means for moving said sealing jaws from said open position to said clamping position under a first pressure after said pusher means moves from said upstream portion to said downstream portion of said table.

21. An apparatus according to claim 20, wherein said control means further comprises a manually operated palm button means operatively connected to said actuating means for activating said actuating means to move said sealing jaws from said open position to said clamping position under said first pressure.

22. An apparatus according to claim 21, and further comprising a detection means for detecting the presence of said sealing jaws in said clamping position; and said control means is operatively connected to said detection means and responds to the detected presence of said sealing jaws in said clamping position to drive said sealing jaws together under a second pressure greater than said first pressure.

23. An apparatus according to claim 22, wherein said sealing means further comprises a thermal severing means for applying heat to said open end of said bag to seal said bag and sever excess material from said bag at said seal; and said control means is further responsive to the detected presence of said sealing jaws in said clamping position to activate said thermal severing means to apply heat to said bag.

24. An apparatus according to claim 23, wherein said control means further comprises a timer means responsive to movement of said pusher means to said downstream portion of said table for measuring a predetermined time period; and is further responsive to said timer means to move said jaws to said open position when said time period ends prior to the detection of said jaws in said clamping position by said detection means.

25. An apparatus according to claim 1, wherein said open end of said bag further comprises an upper portion and a lower portion; and said bag holder means is positioned upstream of said sealing means and comprises an upper holder means for holding said upper portion above said table and a lower holder means for holding said lower portion below said table.

26. An apparatus according to claim 25, wherein said lower holder means further comprises feet means movable between a bottom position where said feet means are out of engagement with said table and a top position where said feet means engage said table for securely clamping said lower portion of said bag between said table and said feet means; and said upper holder means further comprises bucket means pivotal between a lower position where said bucket means is adapted to receive said upper portion of said bag and an upper position where said bucket means securely holds said upper portion of said bag above said table.

27. An apparatus according to claim 26, wherein said control means comprises an actuating means for actuating movement of said feet and bucket means between said bottom and lower positions and said top and upper positions, respectively; and a manually operated foot switch means operatively connected to said actuating means and for activating said actuating means to move said feet and bucket means to said bottom and lower positions, respectively, when said foot switch means is activated and to move said feet and bucket means to said top and upper positions, respectively, when said foot switch means is deactivated.

28. An apparatus according to claim 27, wherein said control means further comprises a timer means operatively connected to said foot switch means and for measuring a predetermined time period when said foot switch means is deactivated; and is further responsive to said timer means to move said bucket means to said upper position at the expiration of said second time period.

29. In an apparatus for packaging articles into a bag having an open end, said apparatus comprising a table for supporting said articles and having an upstream portion and a downstream portion, a bag holder means for supporting said open end of said bag on said table such that said open end faces said upstream portion, a pusher means for forcing said articles from said upstream portion to said downstream portion and into said bag through said open end of said bag, a sealing means comprising a pair of opposed sealing jaws positioned adjacent to said open end of said bag and movable from an open position where said jaws are positioned in spaced-apart relationship to a clamping position where said jaws engage one another for sealing said opened end of said bag, and a source of first pressure coupled to said sealing jaws to drive said jaws toward each other at a first pressure, the improvement which comprises:

a detection means for detecting the presence of said sealing jaws in said clamping position;

a source of second pressure greater than said first pressure; and a control means operatively connected to said detection means and to said sources of first and second pressure, and responsive to the detected presence of said sealing jaws in said clamping position to drive said sealing jaws together under said second pressure.

30. An apparatus according to claim 29, wherein said sealing means further comprises a thermal, severing means for applying heat to said opened end of said bag to seal said bag and sever excess material from said bag at said seal; and said control means is further responsive to the detected presence of said sealing jaws in said clamping position to activate said thermal, severing means to apply heat to said bag.

31. An apparatus according to claim 30, wherein said control means further comprises a timer means responsive to movement of said pusher means to said downstream portion of said table for measuring a predetermined time period; and is further responsive to said timer means to move said jaws to said open position when said time period ends prior to the detection of said jaws in said clamping position by said detection means.

32. In an apparatus for packaging articles into a bag having an open end, an upper portion and a lower portion, said apparatus comprising a table for supporting articles and having an upstream portion and a downstream portion, a pusher means for forcing said row of said articles from said upstream portion to said downstream portion and into said bag through said open end of said bag, a bag holder means for supporting said open end of said bag on said table and comprising upper and lower holder means movable between upper and lower positions and for securely holding said upper and lower portions of said bag above and below said table, respectively, in said upper positions of said upper and lower holder means, a control means for actuating movement of said lower and upper holder means between said upper and lower positions, and a switch means operatively connected to said control means for activating said control means to move said lower and upper holder means to said lower positions when said switch means is activated and to move said lower and upper holder means to said upper positions when said switch means is deactivated, wherein:

said control means further comprises a timer means operatively connected to said switch means and for measuring a predetermined time period beginning at the time said switch means is deactivated; and is further responsive to said timer means to move said upper holder means to said upper position at the expiration of a said time period.

33. An apparatus according to claim 32, wherein said control means actuates said lower holder means to move to said upper position substantially simultaneously with the deactivation of said switch means.

* * * * *